US005216410A

United States Patent [19]

Pildner et al.

[11] Patent Number: 5,216,410

[45] Date of Patent: Jun. 1, 1993

[54] INTRUSION ALARM SENSING UNIT

[75] Inventors: Reinhart K. Pildner, Brampton; Dennis Cecic, Scarborough, both of Canada

[73] Assignee: Digital Security Controls Ltd., Downsview, Canada

[21] Appl. No.: 614,239

[22] Filed: Nov. 16, 1990

[51] Int. Cl.[5] ..... G08B 29/00

[52] U.S. Cl. ..... 340/509; 340/507; 340/521; 340/522

[58] Field of Search ..... 340/509, 500, 506, 522, 340/521, 507

[56] References Cited

U.S. PATENT DOCUMENTS

| | | | |
|---|---|---|---|
| 4,611,197 | 9/1986 | Sansky | 340/522 |
| 4,660,024 | 4/1987 | McMaster | 340/522 |
| 4,710,750 | 12/1987 | Johnson | 340/522 |
| 4,833,450 | 5/1989 | Buccola et al. | 340/522 |
| 4,942,384 | 7/1990 | Yamauchi et al. | 340/522 |

*Primary Examiner*—Donnie L. Crosland

[57] ABSTRACT

The present invention is directed to an intrusion detection system having two different types of motion sensors and processing of the signals produced by the motion sensors in a manner to provide a reliable indication of motion within the space being sensed. The intrusion detection system includes a microprocessor and produces an alarm signal if each sensor is activated within a predetermined time period of each other. The unit is also capable of producing what is referred to as a "trouble" signal, based upon a certain number of unconfirmed event signals, i.e. a signal from only one sensor being received, within a predetermined time, indicating that one of the sensors is not operating properly. Once a certain number of unconfirmed event signals are received, the unit operates in one of at least two different default modes whereby a trouble signal or trouble signal and alarm signal are produced by means of a different logic processing step. The invention is also directed to an intrusion detection system having dual sensors where the user can automatically reset the unit should the system have gone into default mode operation. This is particularly useful in that it reduces service on the units and also provides an easy, convenient manner for the user to restore the device to normal operation when required.

16 Claims, 4 Drawing Sheets

INTRUSION ALARM SENSING UNIT

FIELD OF THE INVENTION

The present invention is directed to a sensing unit of an intrusion detection system with each sensing unit having at least two motion sensors and the processing of the signals from the motion sensors. The invention is also directed to improvements with respect to resetting of such a sensing unit.

BACKGROUND OF THE INVENTION

A number of intrusion detection systems have been proposed using a sensing unit having two motion detecting sensors and processing the signals from these motion detection sensors to produce an alarm signal when appropriate. Typically, signals produced by the sensors within a predetermined time period of each other, indicate a confirmed event and result in an alarm signal. Some sensing units produce a trouble alarm based on certain characteristics of the responses received from the motion detection sensors other than a confirmed event and often are identified as unconfirmed events. Examples of such prior art systems are U.S. Pat. No. 4,710,750 (Johnson), U.S. Pat. No. 4,195,286 (Galvin), U.S. Pat. No. 4,611,197 (Sansky), and U.S. Pat. No. 4,833,450 (Buccola et al).

Such systems produce an alarm signal based on a confirmed event or produce a trouble signal based on some processing of the signals received from the motion sensors based on unconfirmed events. Unfortunately, these systems do not allow the user to significantly vary the characteristics of the sensing unit to suit his own needs or to suit the particular environment in which the unit is being placed. For example, in monitoring of certain space, a very high degree of security may be required where it would be worthwhile if the sensing unit could produce an alarm based on confirmed events or produce an alarm based on certain characteristics of the unconfirmed responses received from the individual sensing units indicating that the unit may not be working satisfactorily or that environmental conditions are creating spurious indications of motion for either one of the sensors. In other environments it may prove particularly bothersome to produce an alarm based on unconfirmed events and it would be much more desirable merely to produce a trouble signal which can then be investigated by the user. Furthermore, it would be desirable to be able to have a system where the user has much more control with respect to resetting of the sensing unit.

SUMMARY OF THE INVENTION

A sensing unit of an intrusion detection system, according to the present invention, comprises at least two motion sensors. The motion sensors, when activated, produce an unconfirmed event signal indicating detection of motion. Logic processing means monitors the unconfirmed event signals and produces an alarm signal if both sensors produce unconfirmed event signals within a predetermined time of each other, thus confirming the event signals. Logic processing means processes the unconfirmed event signals to determine a possible malfunction of the sensing unit or its application within the environment and produces a trouble signal based upon the processed unconfirmed event signals received. The logic processing means when a trouble signal is produced uses one of at least two logic alternatives which are selectable at the sensing unit for determining which logic alternative is used by the sensing unit for subsequent operating characteristics.

In an intrusion detection system, according to the present invention, having at least one sensing unit with each sensing unit comprising at least two motion sensors, a logic processing means monitors unconfirmed event signals originating from the motion sensors and produces an alarm signal when both sensors produced unconfirmed event signals with a predetermined time of each other, thus confirming the event signals. The logic processing means processes the unconfirmed event signals to determine a possible malfunction of the sensing unit and produces a trouble signal based on the processed unconfirmed event signals received. The logic processing means includes a user effected reset condition function for resetting from a default condition based upon sensing a predetermined number of consecutive confirmed event signals whereafter the unit returns to normal operation.

The intrusion detection system of the present invention not only produces an alarm when confirming signals are received from each of the sensors within a specified time of each other, but it also processes unconfirmed event signals and produces a trouble signal based upon a certain requirement or characteristics of the unconfirmed event signals. Two separate and distinct modes with respect to operation of the sensing unit after a trouble signal is produced are included whereby the sensing unit may operate in one of the at least two separate and distinct modes according to the particular requirements of the space being protected or the requirements of the user by varying of the sensing unit.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
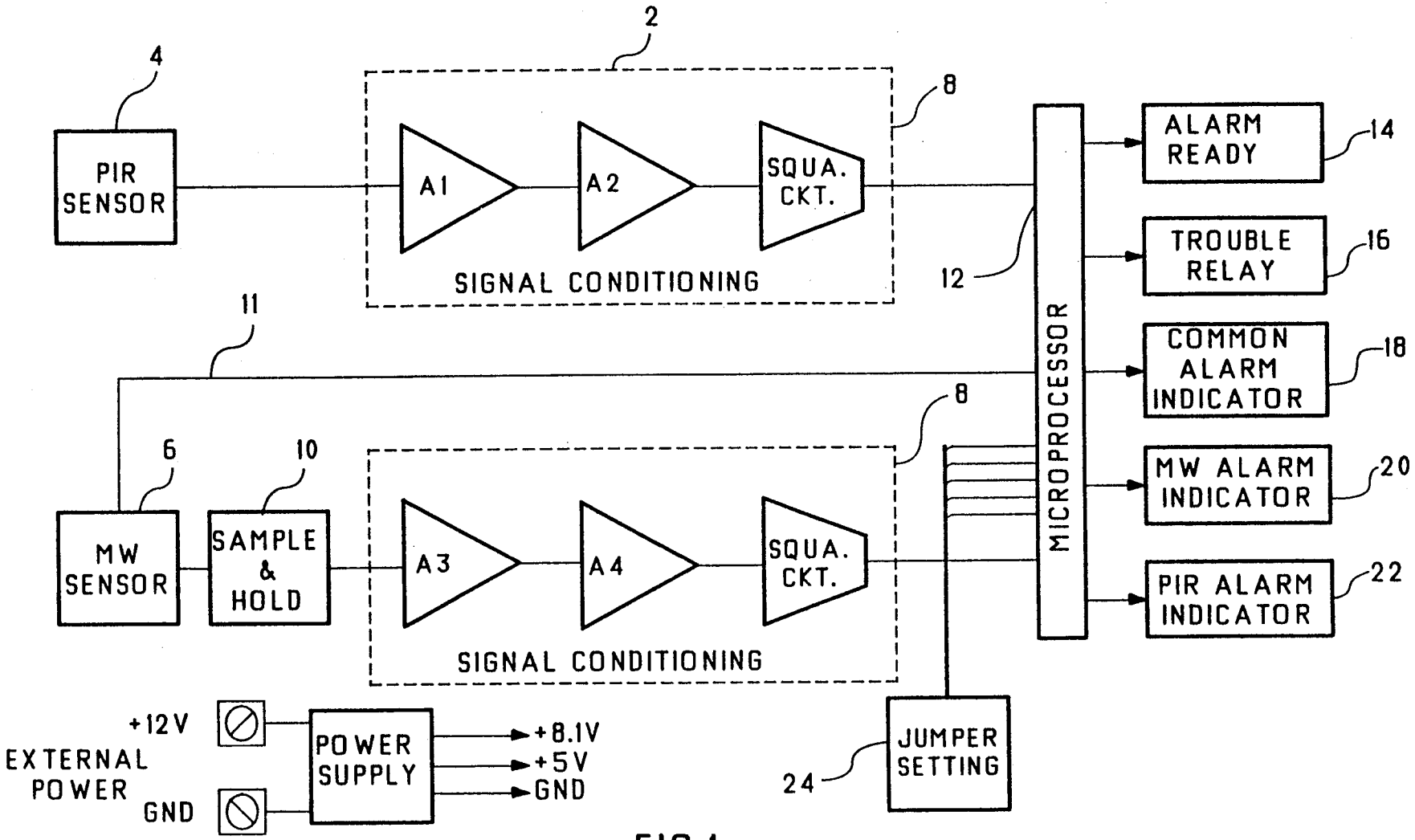
FIG. 1 is a schematic of a sensing unit used in the intrusion detection system.

FIG. 1 schematically illustrates the sensing unit 2 having a passive infrared sensor 4 and a microwave sensor 6 for producing unconfirmed signals with respect to motion within the particular space being protected. The output from sensor 4 is to signal conditioning arrangement 8 rendering it recognizable by the microprocessor 12. The microwave sensor 6 includes a sample and hold logic 10 by means of which a determination of a motion within the space is determined and then this confirmation signal is processed by the signal conditioning arrangement 8 and received by the microprocessor 12. The signal of the microwave sensor 6 requires some analysis by the microprocessor 12 and thus a signal is fed back from the microprocessor by means of line 11. Two separate sensors are used and in the event of a detection of motion in the space by the sensors, a signal is received by the microprocessor indicating that that sensor believes there has been motion within the space. If both sensors produce a signal indicating motion within the space within a predetermined time limit of one another, this results in what is referred to as a confirmed event, i.e. both sensors agree that there has been motion in the space being protected. In such an event, an alarm signal is produced by the microprocessor and outputted to the alarm relay 14. It is believed this type of confirming operation, where a response is required from both sensors, will reduce the possibility of false alarms over the type of motion sensor that only uses a single technology.

One problem with respect to this dual technology is if one of the sensors should fail to operate, or should one of the sensors produce spurious alarms due to environmental conditions, a confirmed alarm may not be produced. In order to avoid such a situation, the present invention processes the signals received from the respective sensors 4 and 6 and evaluates whether a malfunction may have occurred. The microprocessor 12 includes a counter which keeps track of the total unconfirmed event signals received from the sensors. An unconfirmed event signal is a signal produced from one of the sensors which is not confirmed by a similar signal received from the other sensor within a specified period of time. This normal mode of operation is allowed to continue until a certain number of unconfirmed event signals are received. At that point in time, the unit will operate in an additional mode called a default mode.

Preferably, two alternatives are available in default mode with these alternatives being selectable at the sensing unit. The first alternative is referred to as TROUBLE ONLY. In the TROUBLE ONLY mode, the unit produces a trouble signal indicating the specified number of unconfirmed event signals have been received but continues to operate in the normal manner with respect to the alarm signal, i.e. only producing an alarm signal if confirmed event signals are received. The second alternative is referred to as TROUBLE/ALARM mode. In this mode, after the predetermined number of unconfirmed event signals are received, the trouble signal is produced and an alarm signal is produced if confirmed event signals are received or a specified further number of unconfirmed event signals are received within the preset time period. In either mode, the sensor that produced the unconfirmed event signal resulting in the production of the trouble signal is indicated.

The sensing unit 2 also includes an arrangement 24 whereby certain jumpers can be adjusted with respect to the microprocessor 12 for varying of the set for the number of unconfirmed event signals required to initiate the default mode as well as a means for varying the default characteristics of the sensing system between one of two separate and distinct modes of default operation referred to as TROUBLE ONLY or TROUBLE/ALARM.

Figure 2:
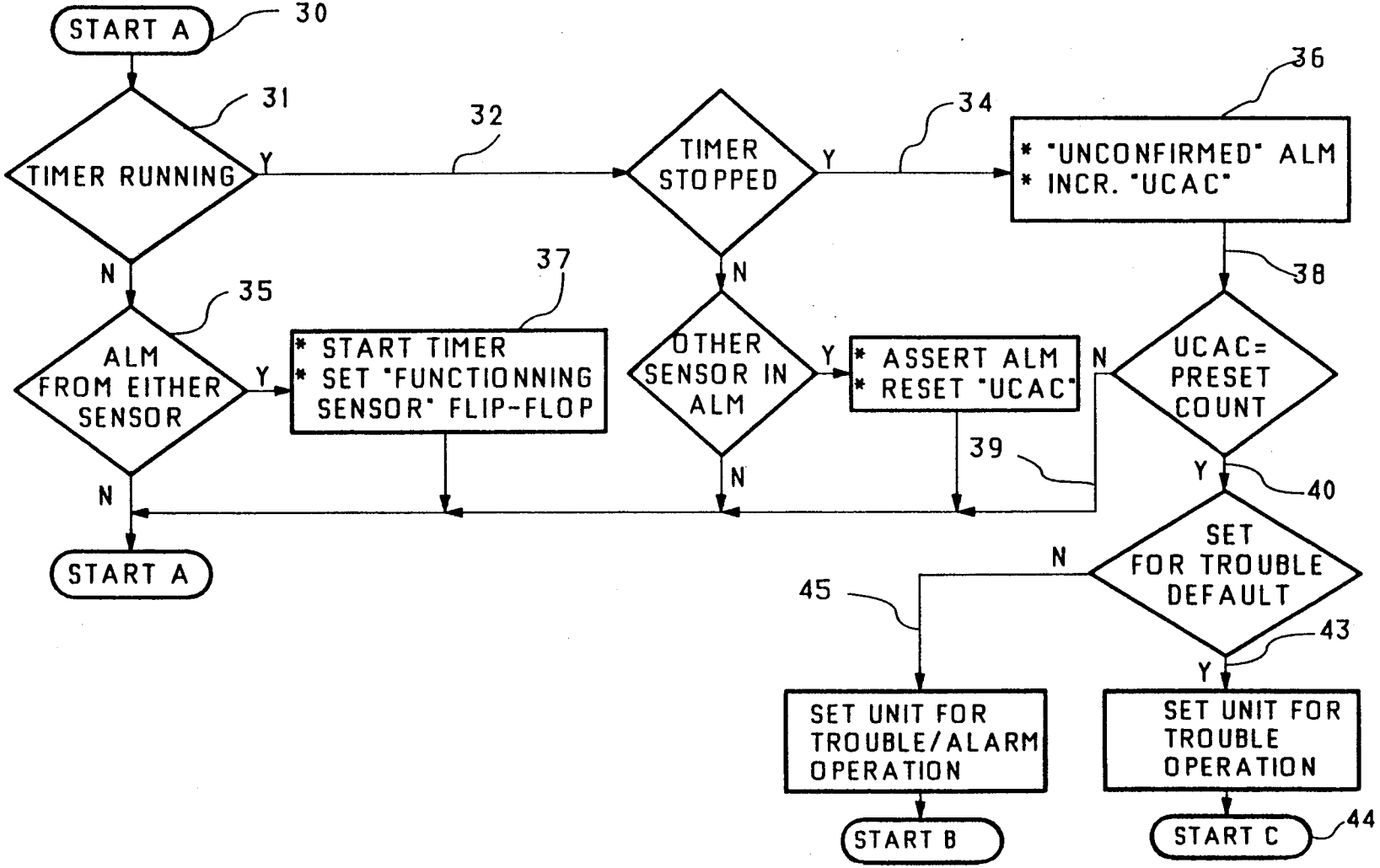
FIG. 2 is a logic chart showing the logic for operating of the sensing unit for producing an alarm based upon confirmed event signals and for allowing operation of different default modes.
Figure 3:
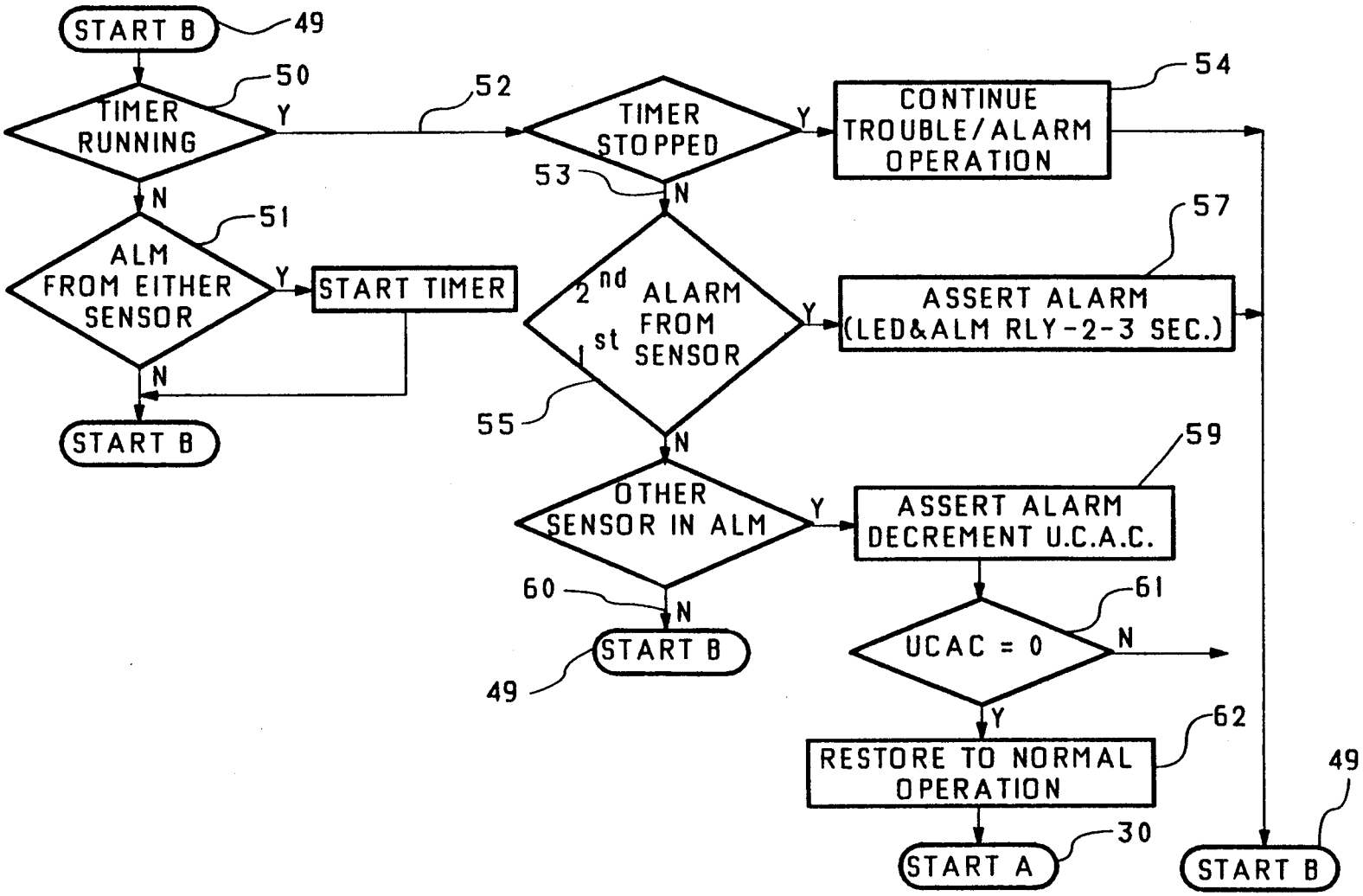
FIG. 3 is a logic chart showing the logic for producing a trouble plus alarm function based on certain characteristics of the unconfirmed event signals.
Figure 4:
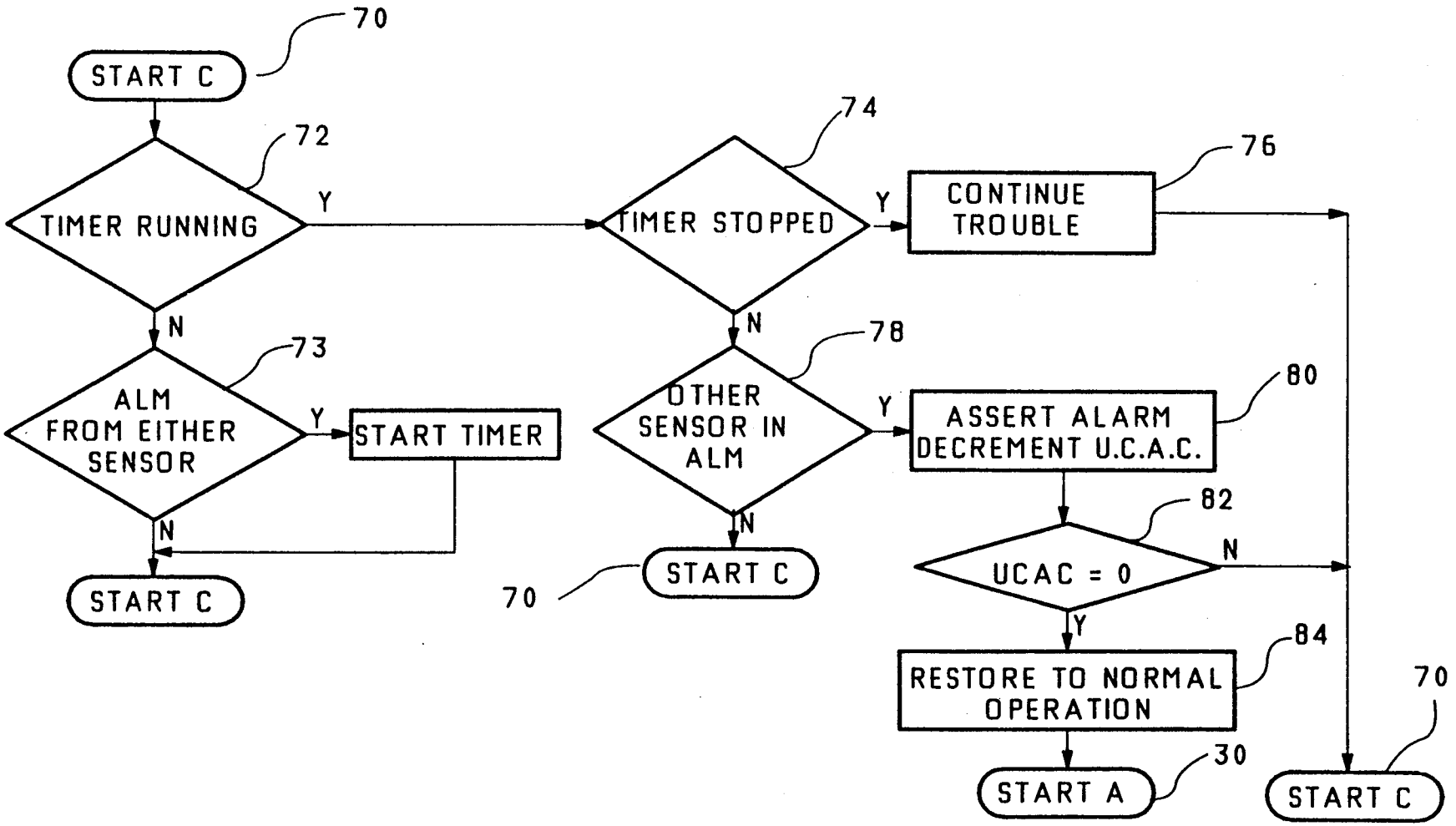
FIG. 4 is a logic diagram showing a different mode of operation where only a trouble signal is produced and an alarm signal is only produced when confirmed event signals are received.

The logic diagram of FIG. 2 is the normal logic for operating the alarm system based upon receiving confirmed event signals and it also illustrates how the device can start to operate in one of the two separate and distinct default modes indicated in the logic diagrams of FIGS. 3 and 4.

In FIG. 2, the device starts at position A, labelled 30, and asks the question, "Is the timer, which starts running upon receiving of a unconfirmed event signal, running?" If the answer is 'yes', it is outputted on line 32 and a second question is asked whether the timer has stopped. If the timer has stopped, indicated by a 'yes', an output is produced on line 34 which results in the decision indicated by box 36 of an unconfirmed alarm and the step of incrementing an unconfirmed alarm counter is carried out. This unconfirmed alarm counter, labelled UCAC, is used to produce a change in the operation of the sensing unit when the unconfirmed alarm counter reaches a predetermined point. After incrementing of the unconfirmed alarm counter, an output is produced at 38 and the question is asked, "Does the count of the unconfirmed alarm counter equal the preset count?" The preset count is preset by the user and will be used to control the actuation point where the device goes into default mode. If the unconfirmed alarm counter has not reached the preset count, the decision follows path 39 and returns to start position A, which is, in effect, a return to position 30 shown in FIG. 2. If the unconfirmed alarm count does equal the preset condition, the answer is 'yes' and the output is produced on line 40. At this point, a determination is made of which of the two default modes is the unit set. This question is asked at 42. If the unit is set for TROUBLE ONLY, path 43 is followed leading to the additional processing indicated by start C indicated as 44. This logic will be discussed with respect to FIG. 4. If the device is not set for trouble only, the output is produced on line 45 and the device then starts a set of operations for indicating a trouble operation on the individual sensing unit, by means of flashing lights etc., and then the logic associated with FIG. 3 is followed.

The logic shown in FIG. 3 produces a signal based on confirmed event signals or on the basis of a specified number of unconfirmed event signals being received from the sensors. The logic is started by the question indicated as 50, "Is the timer running?" The timer is only running if one of the sensors 4 or 6 have sensed a signal. If the question is answered 'yes' path 52 is followed and the following question is asked, "Is the timer stopped?" If the timer is stopped, the action of continuing the trouble alarm operation indicated by box 54 is carried out. This then causes a return to the start position indicated as 49. If, on the other hand, the timer has stopped, path 53 is followed where the next question 55 is asked, "Has a second alarm signal been received from the first sensor?" If the answer is 'yes', an alarm signal is produced indicated by box 57 and the logic will eventually return you to start position 49. If, on the other hand, a second unconfirmed signal from the sensors has not been received, the question is then asked, "Has the other sensor now sensed an unconfirmed event?" If this indeed happens, an alarm is produced at 59. If the other sensor has not sensed a condition, path 60 is followed returning to position 49. The step indicated as 59 where an alarm has been produced also produces the step of decreasing the unconfirmed alarm counter by one. This logic is then passed to the question indicated as 61, "Is the unconfirmed alarm counter equal to zero?" This logic allows the user to conveniently reset the device. The device is reset by producing a host of consecutive confirmed alarm conditions. The user can do this by merely moving within the space and watching that both sensors indicate that motion is being sensed. With each confirmed event, the count of the unconfirmed alarm counter is decreased by one. When the unconfirmed alarm counter reaches zero, the unit is restored to normal operation, indicated by action 62, and returning to start A indicated as 30. Thus, the user has been able to automatically reset the device from the trouble condition of FIG. 3 to return it to normal operation indicated by the logic of FIG. 2 by producing confirmed events sensed by the unit.

The logic of FIG. 4 is for producing only an alarm signal based on confirmed events while producing a trouble signal based on the unconfirmed event signals. The device starts at position 70 and then asks the question, "Is the timer running?", indicated by 72. If the answer to the questions is 'yes', then the question indicated as 74 is asked, "Is the timer stopped?" If the timer is stopped, the device continues to operate in the trouble mode indicated by operation 76. This then returns you to the start position 70. If, on the other hand, the timer is not stopped, question 78 is asked, "Has the other sensor indicated an unconfirmed event signal?" If the question is answered 'yes', an alarm is produced at 80 and the unconfirmed alarm counter is decreased by one. This is part of the automatic reset which is followed by the question 82, "Does the count of the unconfirmed alarm counter equal zero?" When it does equal zero, the device is restored to normal operation indicated as start A by means of step 84. If, on the other hand, the unconfirmed alarm counter does not equal zero, the logic goes to start position 70. Following question 78, if the answer to the question is 'no', i.e. the other sensor is not in an alarm condition, the logic returns to start position 70.

In FIGS. 3 and 4, if the answer is 'no' to the question indicated as 50 in FIG. 3 and 72 in FIG. 4, i.e. is the timer still running, then the question is asked, "Has a signal from either sensor been received?", and if there is a signal from either sensor indicated by questions 51 and 73, the timer is then started and you return to the initial position of 49 in FIG. 3, or 70 in FIG. 4. Therefore, this portion of the loop allows the device to start the timer on a signal being received from either sensor, once the device has been switched to operate in one of the two different default modes indicated in the logic drawings of FIGS. 3 and 4.

Returning to FIG. 2, it can be seen that if the timer is not running, indicated by question 31, the logic proceeds to the next question, indicated as 35, "Has an unconfirmed event signal been received from either sensor?" If the answer is 'no', you return to the start position 30. If the answer is 'yes', you start the timer, indicated by means of operation 37, and you also serve to set a flipflop arrangement indicating which sensor was the one to actually sense the alarm condition. This flip-flop keeps track of which sensor was the last sensor to produce a signal and will be used for diagnostic purposes. For example, when the unconfirmed alarm counter equals the preset value indicated on output 40, the flip-flop will indicate the last sensor to operate causing the unconfirmed alarm counter to reach the preset number. In this way, the user can recognize which sensor was the last to operate prior to starting the default mode.

The intrusion protection system of the present invention allows adjusting of a microprocessor whereby the according to the user's requirements. This is particularly beneficial where the same sensing unit can be adjusted by the installer with respect to very sensitive areas applying the logic of FIG. 3, and for less sensitive areas the logic of FIG. 4 can be applied such that an alarm is only produced when confirmed event signals are received. It is generally recognized that other forms of motion can produce responses in these signals which do not indicate an actual intrusion in the protected space. For example, a window could be left open and something could be blowing or moving with respect to the wind, or, in a house, a dog may have wandered into the unprotected area. In any event, there are applications where a higher degree of security is required in one area and a lesser degree of security in a different area. Areas near windows, etc. in a home might well operate under the logic of FIG. 4, whereas a highly sensitive area, for example an interior room having a safe, etc., might operate under the logic of FIG. 3, as this is a very sensitive area and requires a higher degree of security.

The means of operating the device is such that the unconfirmed alarm counter can have different counts associated with merely different arrangements of the jumper settings shown as 24 in FIG. 1. Also, different arrangement of these four jumper settings will program the device to operate in the TROUBLE ONLY mode of FIG. 4 or the TROUBLE/ALARM mode of FIG. 3.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In an intrusion detection system having at least one sensing unit, each sensing unit comprising at least two motion sensors with each sensor, when activated, producing an unconfirmed event signal indicating detection of motion, and logic processing means for monitoring said unconfirmed even signals of said sensors and producing an alarm signal if both sensors produce unconfirmed event signals within a predetermined time of each other thus confirming the event signals; said logic processing means processing said unconfirmed event signals to determine a possible malfunction of the sensing unit and producing a trouble signal based on the processed unconfirmed event signals received, said logic processing means including selectable means which when selected causes said logic processing means to process further unconfirmed event signals received after a trouble signal has been produced to produce an alarm signal when said further unconfirmed event signals satisfy a predetermined criteria whereby an alarm signal can be produced based upon the receipt of unconfirmed event signals in addition to the alarm signal being produced upon receive of confirming event signals.

2. In an intrusion detection system as claimed in claim 1 including means of determining the last sensor to produce an unconfirmed event signal resulting production of a trouble signal to assist in user system analysis.

3. In an intrusion detection system as claimed in claim 2 wherein said predetermined function of said logic processing means produces an alarm signal upon the further receipt of two additional unconfirmed event signals within a preset time period.

4. In an intrusion detection system as claimed in claim 1 wherein each sensor includes a light emitting diode which flashes when the unit is activated and which remains on if the sensor is the last sensor to produce an unconfirmed event signal which causes said logic processing means to produce an alarm signal.

5. In an intrusion detection system having at least one sensing unit, each sensing unit comprising at least two motion sensor with said sensors, when activated, producing unconfirmed event signals indicating detection of motion, and logic processing means for monitoring said unconfirmed event signals and producing an alarm signal if both sensors produce unconfirmed event signals within a predetermined time of each other thus confirming the event signals; said logic processing means processing said unconfirmed event signals to determine a possible malfunction of the sensing unit and producing a trouble signal based on the processed unconfirmed event signals received, sad logic processing means including selectable means which when selected causes said logic processing means to process unconfirmed event signals to produce an alarm signal when the unconfirmed event signals satisfy a predetermined criteria whereby an alarm signal can be produced based upon the receipt of unconfirmed event signal in addition to the alarm signal being produced upon receipt of confirming event signals.

6. In an intrusion detection system having at least one sensing unit having two motion sensors which cooperate in normal operation to produce an alarm when both sensors are activated and which can operate in a default mode to produce a warning type signal based upon a number of unconfirmed evens with each unconfirmed event being determined by receipt of a signal from one of said sensors while the other sensor is not activated within a predetermined time period; a method of automatically resetting the unit from the default mode to normal operation when the unit senses a predetermined number of consecutive occurrences where both sensors are activated whereby the unit is reset to normal operation.

7. In an intrusion detection system having at least one sensing unit with each sensing unit having at least two motion sensor producing unconfirmed event signals when activated, a method of processing the signals of the sensors comprising monitoring the sensor and determining when each sensor is activated and producing an unconfirmed event signal indicating detection of motion by the activated sensor, in normal operation monitoring the confirmed event signals and producing an alarm signal fi both sensor produce unconfirmed event signals within a predetermine time of each of the thus confirming the event signals; processing the unconfirmed event signals to determine a possible malfunction of the sensing unit and when a malfunction is indicted operating the unit in a default condition which produces a trouble signal based on the processed unconfirmed event signals received and produces an alarm signal when received unconfirmed event signals satisfy a predetermined criteria in addition to creating an alarm signal when confirmed event signals are received and continuing to monitor the signals to recognize a reset condition function for resetting from a default condition to normal operation based upon sensing a predetermined number of consecutive confirmed event signals.

8. In an intrusion detection system as claimed in claim 7 including counting the unconfirmed events of said sensors and when a trouble signal is produced counting confirmed event signals and decreasing by one the counted unconfirmed event signals and upon reaching zero resetting the sensing unit.

9. In an intrusion detection system having at least one sensing unit, each sensing unit comprising at least two motion sensors with each sensor, when activated, producing an unconfirmed event signal indicating detection of motion, and logic processing means for monitoring said unconfirmed event signals and producing an alarm signal if both sensors produce unconfirmed event signals within a predetermined time of each other thus confirming the event signals; said logic processing means processing said unconfirmed event signals to determine a possible malfunction of the sensing unit and producing a trouble signal based on the processed unconfirmed event signals received, said logic processing means including a reset condition function for resetting from a trouble condition based upon sensing a predetermined number of consecutive confirmed event signals whereafter the unit returns to normal operation.

10. In an intrusion detection system as claimed in claim 9 wherein the predetermined number of consecutive counts is the same number as the number of unconfirmed event signals required to produce a trouble signal.

11. In an intrusion detection system as claimed inc claim 10 wherein said logic means includes a counting means for counting unconfirmed events of said sensor, said counting mean when a trouble signal is produced counting confirmed event signals and decreasing by one the counted unconfirmed event signals and upon reaching zero resetting the sensing unit.

12. In an intrusion detection system having at least one sensing unit, each sensing unit comprising at least two motion detection sensors scanning the same area and logic processing mans for processing the output of said motion sensors, each sensing unit including input means associated with said logic processing which adjusts said logic processing means to operate in one of at least two separate and distinct modes with respect to operation of the sensing unit when a trouble signal is generated, said logic processing means producing an alarm signal when separate output signals of said sensor are received within a predetermined time period of each other to indicate a confirmed event, said logic processing means further processing said signals to provide a trouble signal based upon receipt and processing of unconfirmed events, an unconfirmed event being determined by a signal being received from one of si sensors without receiving a corresponding signal from the at least one other sensor within the predetermined, and wherein said at least two separate and distinct modes include;

a) producing only a trouble signal while continuing to operate the sensing unit and producing an alarm signal upon a confirmed event, and b) producing a trouble signal based upon receipt and processing of unconfirmed events, and producing an alarm signal upon a confirmed event, or upon receipt and processing of unconfirmed events which occur after the generation of a trouble signal and which satisfy a predetermined criteria.

13. In an intrusion detection system as claimed in claim 12 wherein the generation of an alarm upon receipt and processing of unconfirmed events is produced upon receipt of a certain number of unconfirmed events within a preset time period.

14. In an intrusion detection system as claimed in claim 12 wherein the generation of an alarm upon receipt and processing of unconfirmed events is produced upon receipt of a certain number of unconfirmed events received from any sensor within a preset time period.

15. In an intrusion detection system as claimed in claim 12 wherein said sensing unit includes means for indicating the last sensor to operate causing the generation of a trouble signal.

16. In an intrusion detection system as claimed in claim 12 wherein said logic processing means including user effected reset condition function for resetting from a trouble condition based upon sensing a predetermined number of consecutive confirmed event signals whereafter the unit returns to normal operation.

* * * * *